US006223379B1

(12) United States Patent
Martin

(10) Patent No.: US 6,223,379 B1
(45) Date of Patent: May 1, 2001

(54) FOOT CLEANER DEVICE

(76) Inventor: Annie L. Martin, 52 Cokerville Dr., Georgetown, SC (US) 29440

( * ) Notice: Subject to any disclaimer, the term of this patent is extended or adjusted under 35 U.S.C. 154(b) by 0 days.

(21) Appl. No.: 09/540,510

(22) Filed: Mar. 31, 2000

(51) Int. Cl.[7] ..... A47K 3/022
(52) U.S. Cl. ..... 15/104.92; 15/160; 4/606
(58) Field of Search ..... 15/104.92, 160; 4/606; 401/9

(56) References Cited

U.S. PATENT DOCUMENTS 2,591,331 * 4/1952 Baumbach .
2,852,793 * 9/1958 Shelton ..... 15/104.92
3,416,178 * 12/1968 James .
3,543,747 * 12/1970 Gustafson .
3,548,439 * 12/1970 Berst .
3,973,286 * 8/1976 Logan .
4,520,525 * 6/1985 Yogi ..... 15/104.92
4,617,917 * 10/1986 Miller .
5,177,829 * 1/1993 Simpson .

* cited by examiner

*Primary Examiner*—Randall E. Chin

(57) ABSTRACT

A foot cleaner device for scrubbing and cleaning one's feet with ease and comfort. The foot cleaner device includes a housing having an extended upper portion, an extended bottom portion having a first portion which is spaced from the extended upper portion thus forming a foot-receiving slot therebetween, and also having a side wall which has an outer side which faces in the foot-receiving slot, and further having a compartment which has a floor with an opening therein with the compartment being used for storing liquid soap; and also includes a plurality of bristles disposed in the foot receiving-slot and upon a second portion of the extended bottom portion; and further includes a pump member depressably disposed in the housing for using liquid soap from the compartment; and also includes a valve member biasedly disposed in the opening to control flow of liquid soap from the compartment; and further includes conduit members connected to the opening and extending in the extended portions and the side wall of the housing with spouts connected thereto and to the bristles; and further includes suction cup members being disposed on a bottom side of the housing for detachably attaching to the floor of a shower stall or bathtub.

14 Claims, 2 Drawing Sheets

FOOT CLEANER DEVICE

BACKGROUND OF THE INVENTION

1. Field of the Invention

The present invention relates to a soap dispensing foot cleaner and more particularly pertains to a new foot cleaner device for scrubbing and cleaning one's feet with ease and comfort.

2. Description of the Prior Art

The use of a soap dispensing foot cleaner is known in the prior art. More specifically, a soap dispensing foot cleaner heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,177,829; U.S. Pat. No. 5,473,788; U.S. Pat. No. 5,321,867; U.S. Pat. No. 5,813,078; U.S. Pat. No. Des. 283,848; and U.S. Pat. No. 3,973,286.

While these devices fulfill their respective, particular objectives and requirements, the aforementioned patents do not disclose a new foot cleaner device. The inventive device includes a housing having an extended upper portion, an extended bottom portion having a first portion which is spaced from the extended upper portion thus forming a foot-receiving slot therebetween, and also having a side wall which has an outer side which faces in the foot-receiving slot, and further having a compartment which has a floor with an opening therein with the compartment being used for storing liquid soap; and also includes a plurality of bristles disposed in the foot receiving-slot and upon a second portion of the extended bottom portion; and further includes a pump member depressably disposed in the housing for using liquid soap from the compartment; and also includes a valve member biasedly disposed in the opening to control flow of liquid soap from the compartment; and further includes conduit members connected to the opening and extending in the extended portions and the side wall of the housing with spouts connected thereto and to the bristles; and further includes suction cup members being disposed on a bottom side of the housing for detachably attaching to the floor of a shower stall or bathtub.

In these respects, the foot cleaner device according to the present invention substantially departs from the conventional concepts and designs of the prior art, and in so doing provides an apparatus primarily developed for the purpose of scrubbing and cleaning one's feet with ease and comfort.

SUMMARY OF THE INVENTION

In view of the foregoing disadvantages inherent in the known types of soap dispensing foot cleaner now present in the prior art, the present invention provides a new foot cleaner device construction wherein the same can be utilized for scrubbing and cleaning one's feet with ease and comfort.

The general purpose of the present invention, which will be described subsequently in greater detail, is to provide a new foot cleaner device which has many of the advantages of the soap dispensing foot cleaner mentioned heretofore and many novel features that result in a new foot cleaner device which is not anticipated, rendered obvious, suggested, or even implied by any of the prior art soap dispensing foot cleaner, either alone or in any combination thereof.

To attain this, the present invention generally comprises a housing having an extended upper portion, an extended bottom portion having a first portion which is spaced from the extended upper portion thus forming a foot-receiving slot therebetween, and also having a side wall which has an outer side which faces in the foot-receiving slot, and further having a compartment which has a floor with an opening therein with the compartment being used for storing liquid soap; and also includes a plurality of bristles disposed in the foot receiving-slot and upon a second portion of the extended bottom portion; and further includes a pump member depressably disposed in the housing for using liquid soap from the compartment; and also includes a valve member biasedly disposed in the opening to control flow of liquid soap from the compartment; and further includes conduit members connected to the opening and extending in the extended portions and the side wall of the housing with spouts connected thereto and to the bristles; and further includes suction cup members being disposed on a bottom side of the housing for detachably attaching to the floor of a shower stall or bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot cleaner device which has many of the advantages of the soap dispensing foot cleaner mentioned heretofore and many novel features that result in a new foot cleaner device which is not anticipated, rendered obvious, suggested, or even implied by any of the prior art soap dispensing foot cleaner, either alone or in any combination thereof.

It is another object of the present invention to provide a new foot cleaner device which may be easily and efficiently manufactured and marketed.

It is a further object of the present invention to provide a new foot cleaner device which is of a durable and reliable construction.

An even further object of the present invention is to provide a new foot cleaner device which is susceptible of a low cost of manufacture with regard to both materials and labor, and which accordingly is then susceptible of low prices of sale to the consuming public, thereby making such foot cleaner device economically available to the buying public.

Still yet another object of the present invention is to provide a new foot cleaner device which provides in the apparatuses and methods of the prior art some of the advantages thereof, while simultaneously overcoming some of the disadvantages normally associated therewith.

Still another object of the present invention is to provide a new foot cleaner device for scrubbing and cleaning one's feet with ease and comfort.

Yet another object of the present invention is to provide a new foot cleaner device which includes a housing having an extended upper portion, an extended bottom portion having a first portion which is spaced from the extended upper portion thus forming a foot-receiving slot therebetween, and also having a side wall which has an outer side which faces in the foot-receiving slot, and further having a compartment which has a floor with an opening therein with the compartment being used for storing liquid soap; and also includes a plurality of bristles disposed in the foot receiving-slot and upon a second portion of the extended bottom portion; and further includes a pump member depressably disposed in the housing for using liquid soap from the compartment; and also includes a valve member biasedly disposed in the opening to control flow of liquid soap from the compartment; and further includes conduit members connected to the opening and extending in the extended portions and the side wall of the housing with spouts connected thereto and to the bristles; and further includes suction cup members being disposed on a bottom side of the housing for detachably attaching to the floor of a shower stall or bathtub.

Still yet another object of the present invention is to provide a new foot cleaner device that allows people who are not able to reach their own feet to now clean and scrub their own feet with ease.

Even still another object of the present invention is to provide a new foot cleaner device that can be easily and conveniently mounted to the floor of either a shower stall or a bathtub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
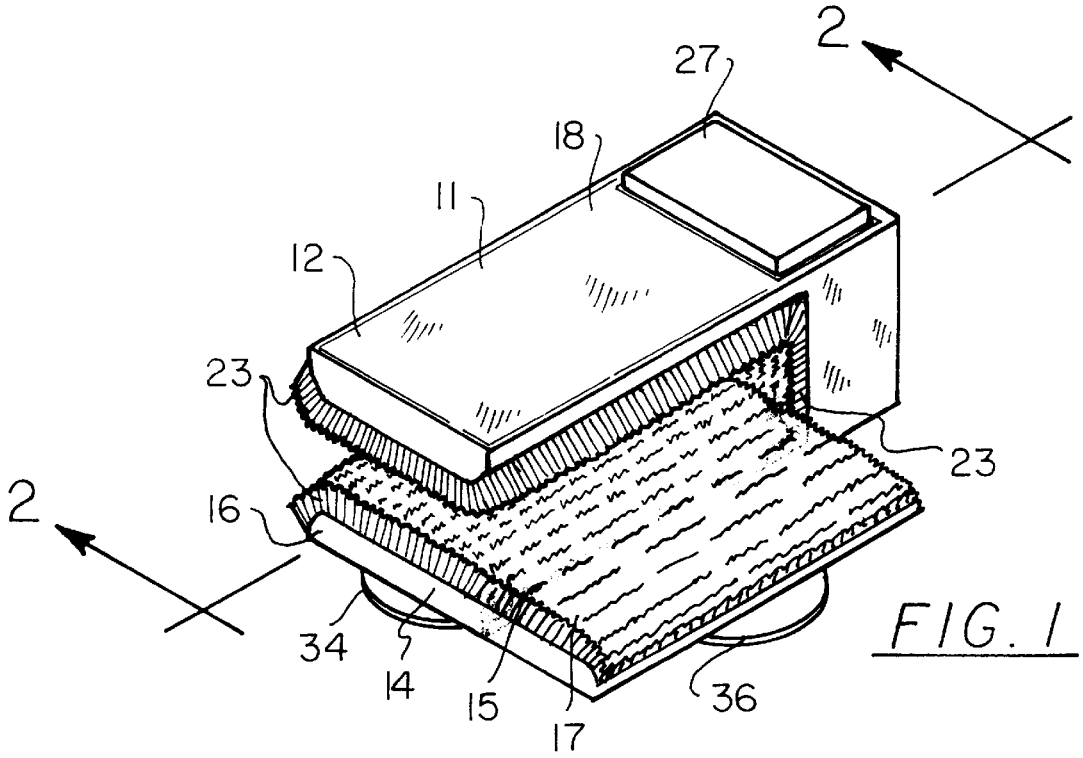
FIG. 1 is a perspective view of a new foot cleaner device according to the present invention.
Figure 2:
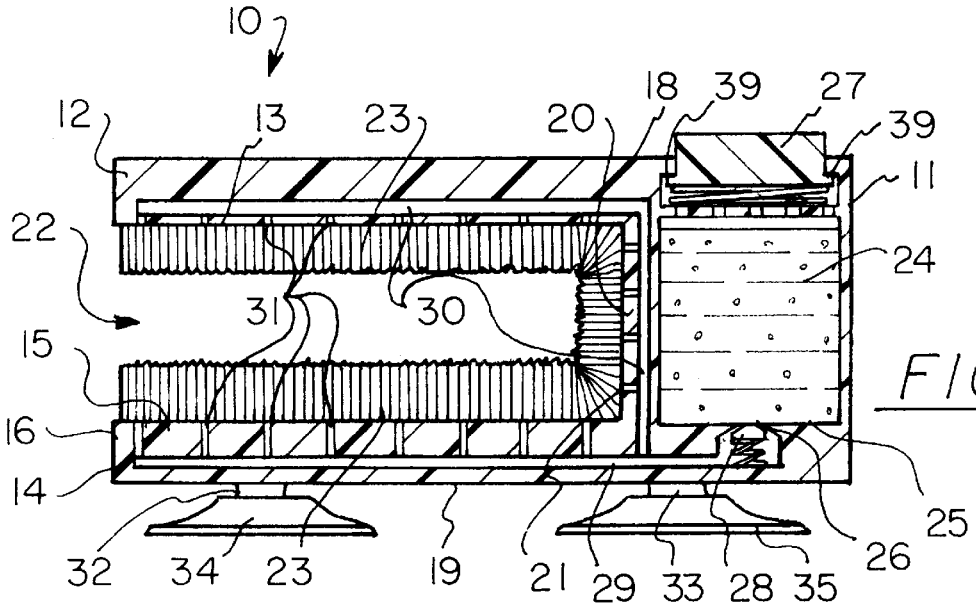
FIG. 2 is a side cross-sectional view of the present invention.
Figure 3:
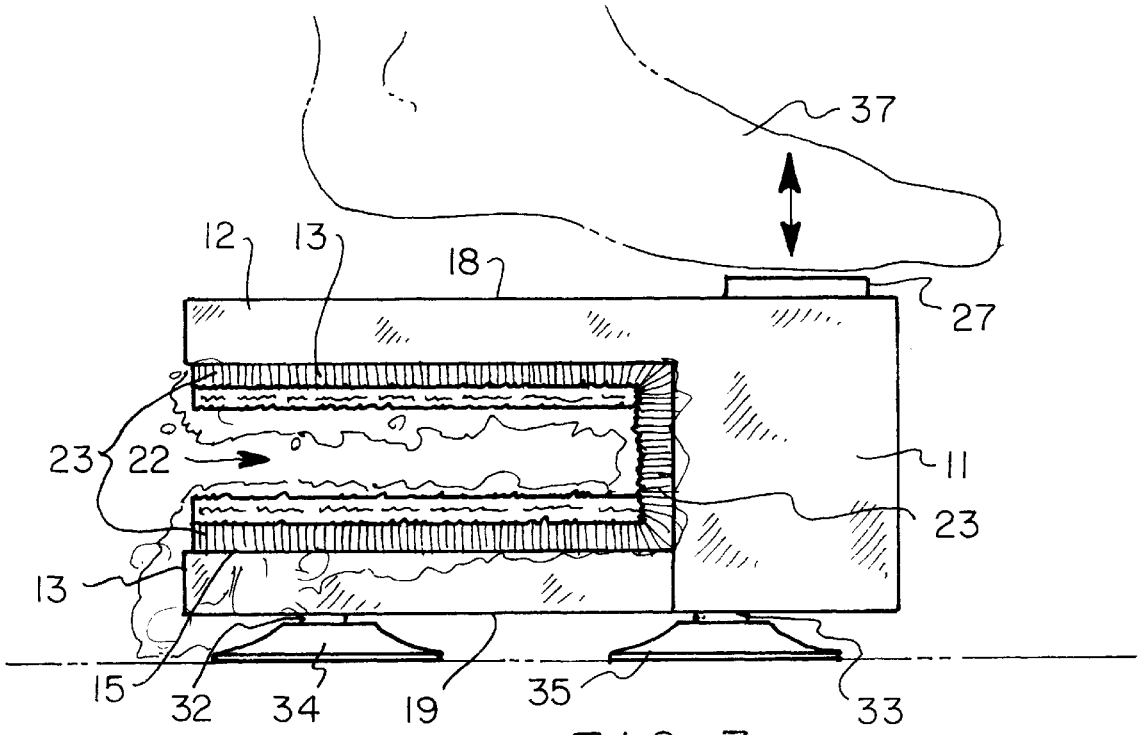
FIG. 3 is a side elevational view of the present invention being used.
Figure 4:
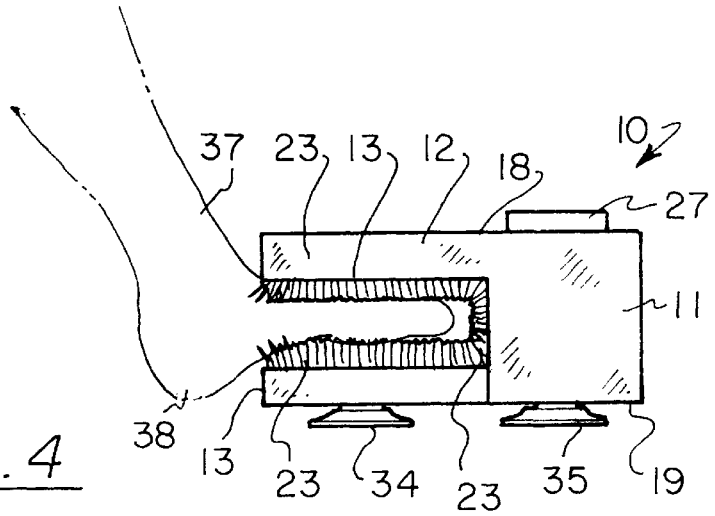
FIG. 4 is another side elevational view of the present invention being used.

With reference now to the drawings, and in particular to FIGS. 1 through 4 thereof, a new foot cleaner device embodying the principles and concepts of the present invention and generally designated by the reference numeral 10 will be described.

As best illustrated in FIGS. 1 through 4, the foot cleaner device 10 generally comprises a housing 11 having an extended upper portion 12, an extended bottom portion 14 having a first portion 16 which is spaced from the extended upper portion 12 thus forming a foot-receiving slot 22 therebetween, and a side wall 20 interconnecting the extended upper portion 12 with the first portion 16 of the extended bottom portion 14 and having an outer side 21 disposed in the foot-receiving slot 22. The extended upper portion 12 has an underside 13 disposed in the foot-receiving slot 22. The extended bottom portion 14 has a top side 15 with the top side of the first portion 16 being disposed in the foot-receiving slot 22. The housing 11 further has an internal compartment 24 adapted for storing liquid soap and having a floor 25 with an opening 26 extending therethrough. The first portion 16 of the extended bottom portion 14 is in vertical alignment with the extended upper portion 12. The extended bottom portion 14 includes a second portion 17 which is integrally connected to the first portion 16 and which is extended outwardly beyond a side of the extended upper portion 12 and which is adapted to support and clean a user's heel 38. A pump member 27 is movably and conventionally disposed in the housing 11 and is conventionally connected to the compartment 24 for urging liquid soap from the compartment 24 through the opening 26. The pump member 27 is depressably disposed in a top wall 18 of the housing 11 above the compartment 24 and is adapted to be operated by the user's foot 37 and has a flange member 39 extending outwardly along a bottom edge thereof for retaining the pump member 27 in the housing 11. A valve member 28 is biasedly and conventionally disposed in the opening 26 for controlling flow of the liquid soap from the compartment 24. A plurality of bristles 23 are securely and conventionally disposed upon the underside 13 of the extended upper portion 12 and upon the outer side 21 of the side wall 20 and upon the top side 15 of the extended bottom portion 14 for scrubbing and cleaning a users' feet 37 including between one's toes. The bristles 23 are securely disposed in the foot-receiving slot 22 and upon the top side of the second portion 17 of the extended bottom portion 14. Means for transporting liquid soap from the compartment 24 to and from the extended bottom portion 14, to and from the side wall 20, and to and from the extended upper portion 12 includes a main conduit member 29 conventionally connected to the opening 26 of the compartment 24 and extending along and in the extended bottom portion 14; and also includes a secondary conduit member 30 conventionally connected to the main conduit member 29 and extending along and in the side wall 20 and extending along and in the extended upper portion 12; and further includes a plurality of spout members 31 conventionally connected to and extending from and spaced along the main 29 and secondary 30 conduit members for dispensing liquid soap to the bristles 23 with the spouts 31 being connected to the bristles 23. Means for detachably attaching the housing II to a floor of a shower or a bathtub includes a plurality of support members 32,33 securely and conventionally attached to the bottom side 19 of the housing 11; and also includes a plurality of suction cup members 34–36 each of which is securely and conventionally mounted to a respective one of the support members 32,33 and which is adapted to detachably mount to the floor of either a shower stall or a bathtub. The suction cup members 34–36 include at least one of the suction cup members 36 which is securely disposed on the bottom side of the second portion 17 of the extended bottom portion 14.

In use, the user positions the foot cleaner device 10 on the floor of the shower stall or bathtub and by using one's foot 37, the user presses down upon the pump member 27 which urges liquid soap through the opening 26 in the compartment 24 and through the conduit members 29,30 and out of the spouts 31 onto the bristles 23 where the user cleans one's foot 37 or feet by extending one's foot 37 in the foot-receiving slot 22 and scrubs the foot by moving one's foot 37 back and forth across the bristles 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot cleaner device comprising:

a housing having an extended upper portion, an extended bottom portion having a first portion which is spaced from said extended upper portion thus forming a foot-receiving slot therebetween, a side wall interconnecting said extended upper portion with said extended bottom portion, said extended upper portion having an underside disposed in said foot-receiving slot, said extended bottom portion having a top side, said housing further having an internal compartment adapted for storing liquid soap and having a floor with an opening extending therethrough;

a pump member being movably disposed in said housing and being connected to said compartment for urging liquid soap from said compartment through said opening;

a valve member biasedly disposed in said opening for controlling flow of the liquid soap from said compartment;

means for transporting liquid soap from said compartment to and from said extended bottom portion, to and from said side wall, and to and from said extended upper portion;

a plurality of bristles securely disposed upon said underside of said extended upper portion, upon said side wall, and upon said top side of said extended bottom portion, said bristles being securely disposed in said foot-receiving slot; and means for detachably attaching said housing to a floor of a shower or a bathtub;

wherein said first portion of said extended bottom portion is in substantial vertical alignment with said extended upper portion; and wherein said extended bottom portion includes a second portion which is integrally connected to said first portion and which is extended outwardly beyond a side of said extended upper portion and which is adapted to support and clean a user's heel.

2. A foot cleaner device as described in claim 1, wherein said pump member is depressably disposed in a top wall of said housing above said compartment and is adapted to be operated by the user's foot.

3. A foot cleaner as described in claim 1, wherein said pump member includes a flange member extending outwardly from a bottom edge thereof for retaining said pump member in said housing.

4. A foot cleaner device as described in claim 1, wherein said means for transporting liquid soap from said compartment includes a main conduit member connected to said opening of said compartment and extending along and in said extended bottom portion; and also includes a secondary conduit member connected to said main conduit member and extending along and in said side wall and extending along and in said extended upper portion; and further includes a plurality of spout members connected to and extending from and spaced along said main and secondary conduit members for dispensing liquid soap to said bristles.

5. A foot cleaner device as described in claim 4, wherein said spouts are connected to said bristles.

6. A foot cleaner device as described in claim 4, 1, wherein said means for detachably attaching said housing to a floor of a shower or bathtub includes a plurality of support members securely attached to a bottom side of said housing; and also includes a plurality of suction cup members each of which is securely mounted to a respective one of said support members and which is adapted to detachably mount to the floor of either a shower or a bathtub.

7. A foot cleaner device as described in claim 6, wherein said suction cup members includes at least one of said suction cup members which is securely disposed on a bottom side of said second portion of said extended bottom portion.

8. A foot cleaner device comprising:

a housing having an extended upper portion, an extended bottom portion having a first portion which is spaced from said extended upper portion thus forming a foot-receiving slot therebetween, a side wall interconnecting said extended upper portion with said extended bottom portion and having an outer side disposed in said foot-receiving slot, said extended upper portion having an underside disposed in said foot-receiving slot, said extended bottom portion having a top side, said housing further having an internal compartment adapted for storing liquid soap and having a floor with an opening extending therethrough, said first portion of said extended bottom portion being in vertical alignment with said extended upper portion, said extended bottom portion including a second portion which is integrally connected to said first portion and which is extended outwardly beyond a side of said extended upper portion and which is adapted to support and clean a user's heel;

a pump member being movably disposed in said housing and being connected to said compartment for urging liquid soap from said compartment through said opening, said pump member being depressably disposed in a top wall of said housing above said compartment and being adapted to be operated by the user's foot, said pump member having a flange member extending along a bottom edge thereof for retaining said pump member in said housing;

a valve member biasedly disposed in said opening for controlling flow of the liquid soap from said compartment;

a plurality of bristles securely disposed upon said underside of said extended upper portion, upon said outer side of said side wall, and upon said top side of said extended bottom portion for scrubbing and cleaning a users' feet including between one's toes, said bristles being securely disposed in said foot-receiving slot and upon said top side of said second portion of said extended bottom portion;

means for transporting liquid soap from said compartment to and from said extended bottom portion, to and from said side wall, and to and from said extended upper portion including a main conduit member connected to said opening of said compartment and extending along and in said extended bottom portion; and also including a secondary conduit member connected to said main conduit member and extending along and in said side wall and extending along and in said extended upper portion; and further including a plurality of spout members connected to and extending from and spaced along said main and secondary conduit members for dispensing liquid soap to said bristles, said spouts are connected to said bristles; and means for detachably attaching said housing to a floor of a shower or a bathtub including a plurality of support members securely attached to a bottom side of said housing; and also including a plurality of suction cup members each of which is securely mounted to a respective one of said support members and which is adapted to detachably mount to the floor of either a shower or a bathtub, said suction cup members including at least one of said suction cup members which is securely disposed on a bottom side of said second portion of said extended bottom portion.

9. A foot cleaner device comprising:

a housing having an extended upper portion, an extended bottom portion having a first portion which is spaced from said extended upper portion thus forming a foot-receiving slot therebetween, a side wall interconnecting said extended upper portion with said extended bottom portion, said extended upper portion having an underside disposed in said foot-receiving slot, said extended bottom portion having a top side, said housing further having an internal compartment adapted for storing a cleaning solution, said internal compartment having an opening therein;

a pump for pumping cleaning solution from said compartment;

conduits for transporting cleaning solution from said compartment to said extended bottom portion, to said side wall, and to said extended upper portion;

a plurality of bristles mounted on said underside of said extended upper portion, on said side wall, and on said top side of said extended bottom portion; and means for detachably attaching said housing to a floor surface;

wherein said first portion of said extended bottom portion lies below said extended upper portion; and wherein said extended bottom portion includes a second portion which extends outwardly beyond a side of said extended upper portion and which is adapted to support and clean a user's heel.

10. A foot cleaner device as described in claim 9, wherein said pump includes a depressible button mounted on a top of said housing above said compartment for operation by the user's foot.

11. A foot cleaner as described in claim 9, wherein said conduits comprise a main conduit member connected to said opening of said compartment and extending along and in said extended bottom portion; and also includes a secondary conduit member connected to said main conduit member and extending along and in said side wall and extending along and in said extended upper portion; and further includes a plurality of spout members connected to and extending from and spaced along said main and secondary conduit members for dispensing liquid soap to said bristles.

12. A foot cleaner device as described in claim 11, wherein said spouts are connected to said bristles.

13. A foot cleaner device as described in claim 9, wherein said means for detachably attaching said housing to a floor surface includes a plurality of support members securely attached to a bottom side of said housing; and also includes a plurality of suction cup members each of which is securely mounted to a respective one of said support members and which is adapted to detachably mount to the floor of either a shower or a bathtub.

14. A foot cleaner device as described in claim 13, wherein said suction cup members includes at least one of said suction cup members which is securely disposed on a bottom side of said second portion of said extended bottom portion.

* * * * *